United States Patent [19]

Sugimoto

[11] Patent Number: 4,969,846

[45] Date of Patent: Nov. 13, 1990

[54] MAN-POWERED BOAT PROPULSION DEVICE

[76] Inventor: Hiroshi Sugimoto, 19-20, Turugaoka 1-chome, Nobeoka-shi, Miyazaki, Japan

[21] Appl. No.: 472,739

[22] Filed: Jan. 31, 1990

[51] Int. Cl.[5] ..... B63H 1/36

[52] U.S. Cl. ..... 440/14; 440/32

[58] Field of Search ..... 440/13-21, 440/25, 26, 29-32, 101-103

[56] References Cited

U.S. PATENT DOCUMENTS

| | | | |
|---|---|---|---|
| 775,155 | 11/1904 | Thompson | 440/14 |
| 1,937,907 | 12/1933 | Nock | 440/14 |
| 2,364,255 | 12/1944 | Troth | 440/14 |
| 2,696,797 | 12/1954 | Whidden | 440/14 |
| 3,834,343 | 9/1974 | Hopkins | 440/14 |

FOREIGN PATENT DOCUMENTS

| | | | |
|---|---|---|---|
| 62-71097 | 6/1987 | Japan | 440/14 |

*Primary Examiner*—Joseph F. Peters, Jr.
*Assistant Examiner*—Clifford T. Bartz
*Attorney, Agent, or Firm*—Morrison Law Firm

[57] ABSTRACT

A man-powered boat propulsion device comprising a hand rod reciprocated horizontally by rowers, a vertical support rod moveably suspended from and slidably supporting the hand rod on a sliding support, an operation rod pivoted to the hand rod, a vertical shaft interlocked with the operation rod and capable of rotating clockwise and counter-clockwise, a fin blade secured to the shaft and capable of horizontally rotating both rightward and leftward alternately, a handle a connected to the hand rod, a change-over device connected to the handle and capable of transmitting a turning movement of the handle either clockwise or counter-clockwise changeably, and a direction control device connected between the change-over device and the shaft for transmitting the handle turning movement. Easy boat propulsion and steering is possible even of unskilled persons.

8 Claims, 10 Drawing Sheets

MAN-POWERED BOAT PROPULSION DEVICE

BACKGROUND OF THE INVENTION

1. Field of the Invention

The present invention concerns a man-powered boat propulsion device.

2. Description of the Prior Art

Man-powered boat propulsion devices which have been used traditionally include, for example, Japanese sculls (single-scull) used in Japanese sampans or inshore fishing boats and oars used generally in various passenger boats, cutters, etc.

A boat equipped with a Japanese scull can easily be steered by a skilled person, but it usually takes a long time for a person become skilled in managing such a scull. In addition, there is the problem that the propulsive efficiency of a boat equipped with a scull is not as high as that of a boat equipped with oars.

On the other hand, a boat with oars can be simply steered by anyone, but a single oar stroke requires movement of the entire body, which greatly consumes rower's energy. Further, since oars are disposed on both sides of the boat, they hinder fishing operations, etc. from the boat.

The present inventor has already proposed a boat propulsion device for overcoming the foregoing problems, in Japanese Utility Model Laid Open No. Sho 62-71097.

The boat propulsion device in this prior invention comprises a rotational rod which is extensible at both ends and is rotatable about its center as a support point by a driving device, a connection rod hinged to a shaft rod which is rotatably attached at one end to an extensible end of the rotational rod and which rotates leftward and rightward alternately at its other end accompanying the rotation of the rotational rod, and fin-like propulsion means which is connected to the shaft rod by a gear train and which swings laterally in accordance with the alternate rightward and leftward rotation of the shaft rod.

However, in the boat propulsion device constituted as above, since the rotational rod is adapted to be rotated as a driving shaft by the driving device utilizing a prime mover, and transmit the rotational power to the fin-like propulsion means, it is difficult to manually rotate the rotational rod as the driving shaft.

It is, accordingly, an object of the present invention to overcome the foregoing problems in the prior art and provide a man-powered boat propulsion device that can be used to manually generate a large propulsion power for moving the boat, enables an easy steering operation, improves the boat's turning performance and stopping performance, easily moves the boat astern or ahead, and also can be handled by anyone.

SUMMARY OF THE INVENTION

The foregoing object of the present invention can be attained by a man-powered boat propulsion device mounted on a coat comprising:

- a first rod-like means reciprocated horizontally by rower's hands,
- a second rod-like means connected vertically at its upper end to said first rod-like means and capable of moving along an arcuate trace in accordance with a reciprocating movement of said first rod-like means,

- a support means disposed in sliding contact with a lower end of said second rod-like means for slidably supporting and guiding said lower end along an arcuate trace,
- a third rod-like means pivoted at its one end to a portion of said second rod-like means and capable of swinging rightward and leftward alternately around said pivoted portion as a center,
- a shaft-like means connected vertically at its one end to the other end of said third rod-like means by way of an interlocking means and capable of rotating horizontally clockwise and counterclockwise alternately in accordance with the horizontal reciprocating movement of said first rod-like means,
- a fin-like propulsion means secured to said shaft-like means and capable of horizontally rotating both rightward and leftward, in accordance with the alternate clockwise and counterclockwise rotation of said shaft-like means,
- a handling means connected to said first rod-like means and capable of turning clockwise and counterclockwise,
- a change-over means connected to said handling means and capable of transmitting the turning movement of said handling means, changeably between clockwise and counterclockwise directions, and
- a direction control means connected to said change-over means on one hand and to said shaft-like means on the other hand and capable of transmitting the turning movement to said shaft-like means.

Horizontal reciprocating of the first rod-like means is transmitted by way of the second rod-like means, which is supported by the second rod-like means on the support means, to the third rod-like means as the rightward and leftward alternate swinging movement, translated into the clockwise and counterclockwise alternate rotation of the shaft-like means and then finally to the fin-like propulsion means as the horizontal alternate rightward and leftward rotation, thereby causing propulsive force to the boat.

Accordingly, it is only necessary for a rower, for advancing the boat, to horizontally reciprocate the first rod-like means.

Further, direction of the boat, can be changed easily by merely turning the handling means, thereby actuating the change-over means and transmitting the turning movement of the handling means by way of the direction control means to the shaft-like means as the alternate clockwise or counterclockwise rotation.

Therefore, boat rowing and steering operations can be much facilitated.

DESCRIPTION OF THE ACCOMPANYING DRAWINGS

DESCRIPTION OF THE PREFERRED EMBODIMENTS

Constitution of the Propulsion Device

Figure 1:
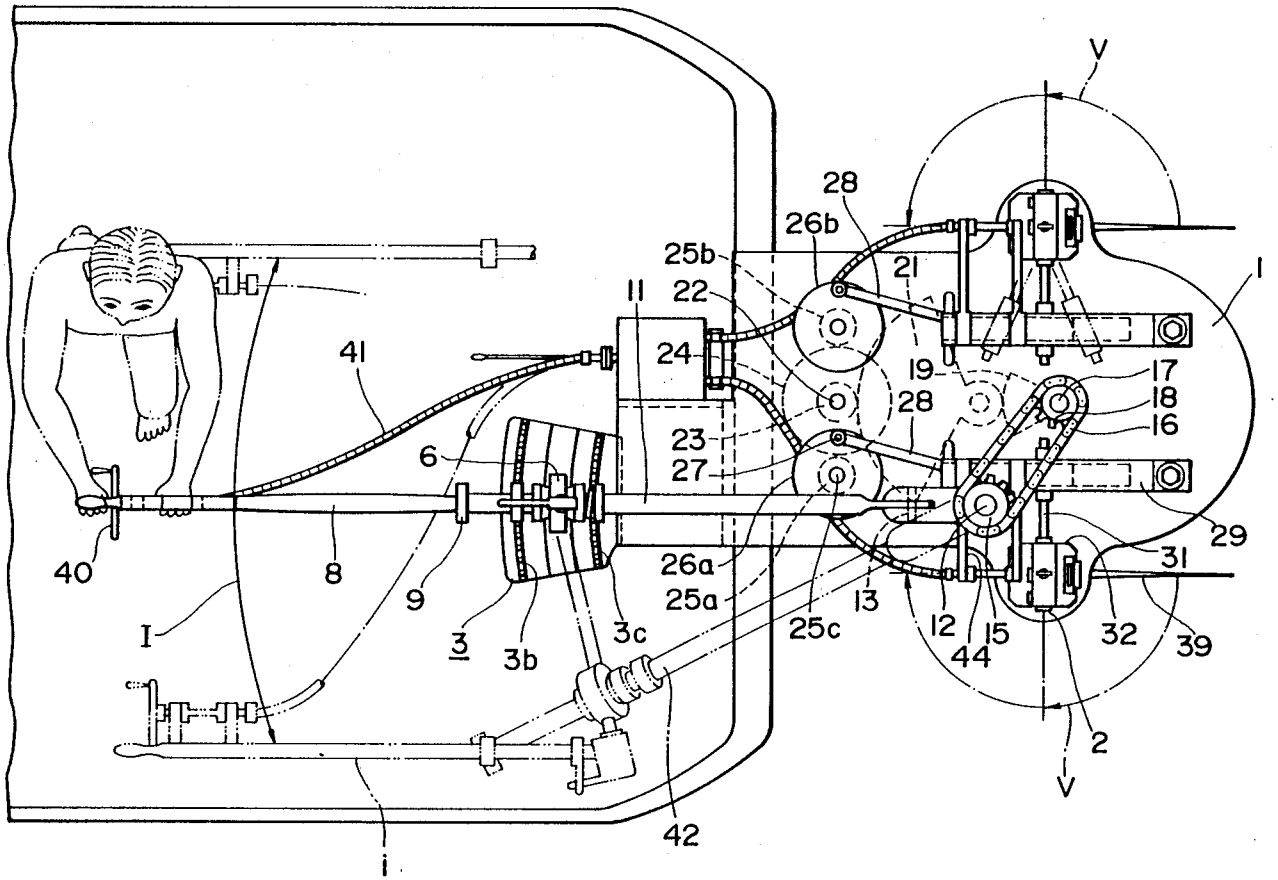
FIG. 1 is a plan view of one embodiment of a man-powered boat propulsion device according to the present invention in a state where the device is mounted on the stern of the boat.
Figure 2:
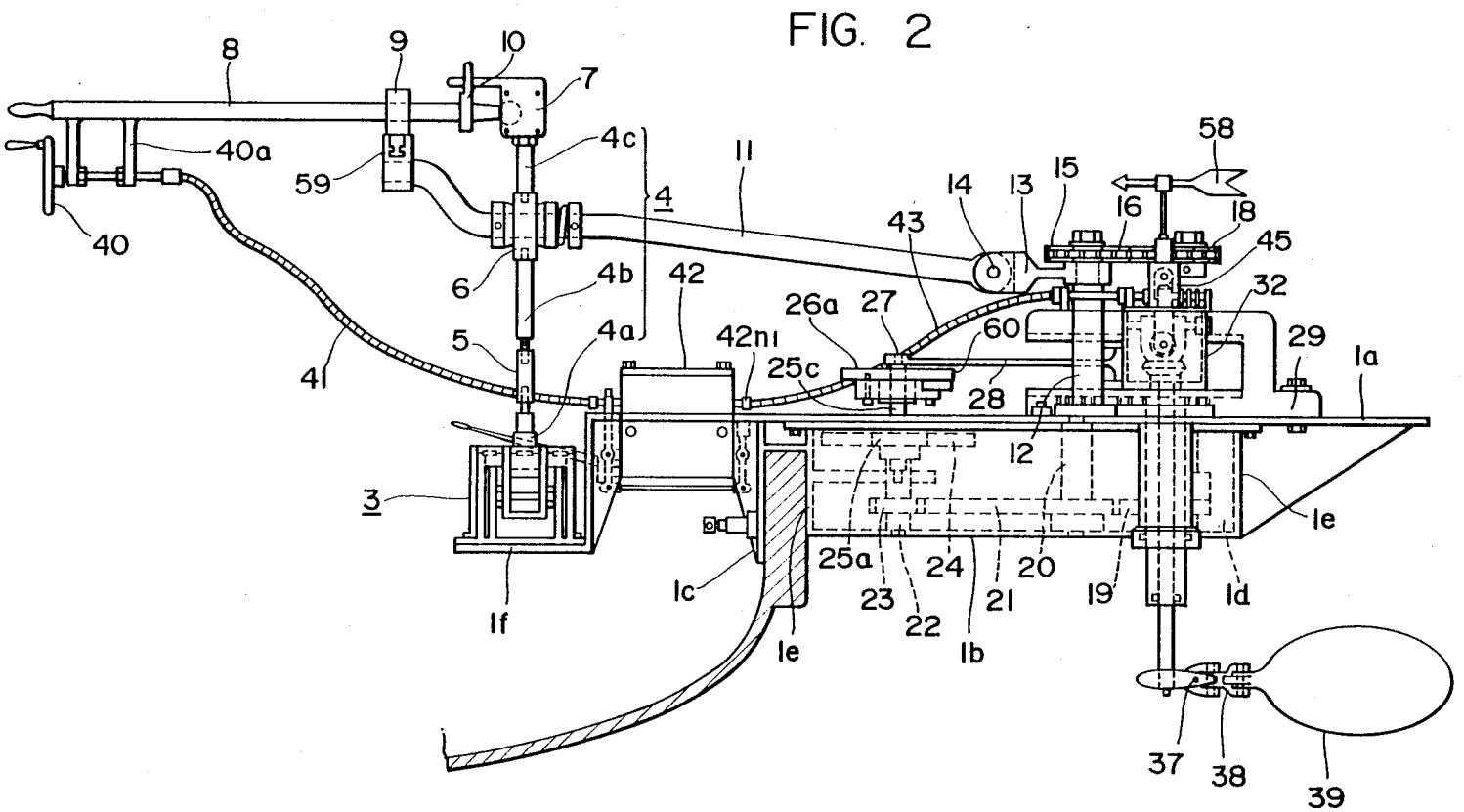
FIG. 2 is a front elevational view of the device shown in FIG. 1.

As shown in FIGS. 1 and 2, a frame 1 of a man-powered propulsion device is secured to the stern of a boat. The frame 1 comprises an upper plate 1*a* of a generally rectangular shape, a lower plate 1*b* of a generally rectangular shape and shorter than the upper plate 1*a*, a mounting plate 1*c* for the man-powered propulsion device, a front plate 1*d*, a rear plate (not shown), and a pair of side plates 1*e*. An extended portion 2 is formed on each of the upper and the lower plates 1*a* and 1*b* at about the longitudinal center of each of the plates.

The upper plate 1*a* is bent downward at its front end to form an integral support plate 1*f* at a level lower than the upper plate 1*a*. A rod sliding support device 3 is secured to this support plate 1*f*.

Figure 7:
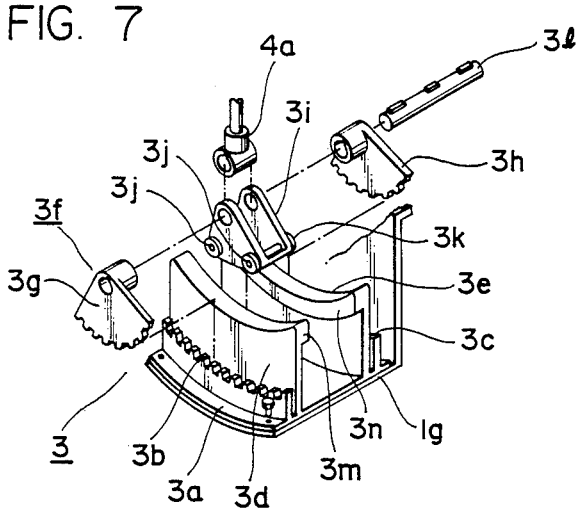
FIG. 7 is an exploded perspective view of a sliding support device.
Figure 8:
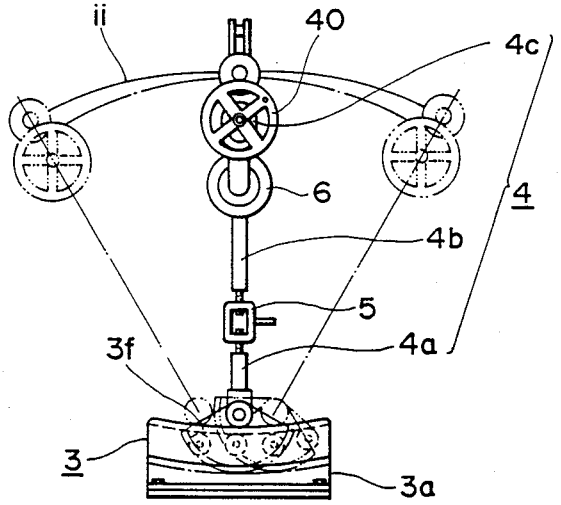
FIG. 8 is a right side elevational view illustrating the state of the sliding support device, a support rod, and a hand rod in operation.

As shown in FIGS. 1, 7 and 8, the sliding support device 3 comprises a slide bed 3*a* and a sliding body 3*f* that moves in sliding contact with the upper surface of the slide bed 3*a*.

The slide bed 3*a* is generally of a rectangular shape, as viewed from above, the longer sides thereof each being formed as a portion of an arc, the arcs being of different radii. Plate gears 3*b* and 3*c* are formed on the outer longer sides and the inner longer sides, respectively, of the slide bed 3*a*. Each of the plate gears 3*b*, 3*c* has a upwardly concave arcuate shape with a row of teeth pointing upward. Guide walls 3*d* and 3*e* are disposed adjacent to the inner sides of the plate gears 3*b* and 3*c*, respectively. The upper surface of each of the guide walls 3*d*, 3*e* has a downwardly concave arcuate shape and has a guide 3*m*, 3*n* extended horizontally each along the upper end of the corresponding wall.

The sliding body 3*f* comprises a pair of sector gears 3*g*, 3*h* meshing with the plate gears 3*b*, 3*c*, respectively, a connector 3*i* for connecting the sector gears 3*g*, 3*h*, and a support rod 4*a*, described below, which are assembled together by means of a fixing shaft 31.

Rotational rings 3*j*, 3*k* are disposed on either sides of the connector 3*i*, respectively, in such a way that the connector 3*i* can move smoothly in sliding contact with the guide walls 3*d*, 3*e* by guiding the rotational rings 3*j*, 3*k* along the guides 3*m*, 3*n*, respectively.

As shown in FIGS. 2 and 7, a support rod 4 (second rod-like means) comprises three support bars 4*a*, 4*b*, and 4*c* connected one above the other. The lower end of the support bar 4*a* is pivoted vertically on the sliding body 3*f*.

An adjusting metal piece 5 in an O-shaped configuration, for adjusting the height of the support rod 4, is connected between the upper end of the support bar 4*a* and the lower end of the support bar 4*b*, while an annular receptacle 6 for receiving an operation rod 11 (third rod-like means) is secured between the upper and of the support bar 4*b* and the lower end of the support bar 4*c*. Further, a receptacle 7 for receiving a hand rod 8 (first rod-like means) is secured at the upper end of the support rod 4*c*, and a spherical top end of the hand rod 8 is inserted into both an annular receptacle 9 and a rotation stopper 10.

The operation rod 11 is pivoted at one end by means of a joint 59 on a lower end of the hand rod receptacle 9, and the operation rod 11 extends as far as an intermediate portion in front of the left extension 2 of the upper plate 1*a* (refer to FIG. 1).

As shown in FIGS. 1 and 2, a support stud 12 stands vertically on the upper plate 1*a* at a forward portion of the left extension 2, and an operation arm 13 is rotatably mounted to the upper end of the support stud 12. The operation rod 11 is connected at its the other end by way of a hinge 14 to the top end of the operation arm 13. A sprocket 15 is secured around the axial center of the operation arm 13. A support shaft 17 rotatable around its axial center stands vertically on the lower plate 1*b* and passes through a central portion of the upper plate 1*a*, and another sprocket 18 is disposed to the upper end of the support shaft 17. Then, the sprocket 18 is connected by way of a chain 16 to the sprocket 15. Under the upper plate 1*a*, a small sector gear 19 is secured to a lower portion of the support shaft 17 along the longitudinal center line of the frame 1. In front of the small sector gear 19, a support shaft 20 rotatable around its axial center is disposed between the upper plate 1*a* and the lower plate 1*b*. A compound gear 21 comprising a small sector gear portion and a large sector gear portion is secured to the lower end of the support shaft 20. The small sector gear portion of the compound gear 21 meshes with the small sector gear 19. Further, in front of the compound gear 21, a support shaft 22 rotatable around its axial center is disposed between the upper plate 1*a* and the lower plate 1*b*, and a spur gear 23 is secured to the lower end of the support shaft 22. The spur gear 23 meshes with the large sector gear portion of the compound gear 21. Further, a spur gear 24 is secured to the upper end of the support shaft 22 and the spur gear 24 meshes with small spur gears 25*a*, 25*b* situated to the right and left thereof.

Subsequent to the gears 25*a*, 25*b*, there are disposed a pair of identical mechanisms in a symmetry relative to the longitudinal center line of the frame 1. Descriptions will be made mainly for the mechanisms disposed on the left (as viewed toward the bow).

As shown in FIGS. 1 and 2, the shaft 25*c* for the small spur gear 25*a* stands vertically on the upper plate 1*a* and a crank disk 26*a* is secured to upper end of the shaft. A balance 60 is attached to the lower surface of the crank disk 26*a*. A connection stud 27 is disposed to the upper circumferential edge of the crank disk 26*a*, to which one end of a crank shaft 28 is pivoted. A cylindrical bearing 28*a* is formed to the other end of the crank shaft 28, and the bearing 28*a* is rotatably engaged to a slide body 30 present in a slide bed 29 secured to a backward left portion of the upper plate 1*a* (refer to FIG. 11). The slide bed 29 has a U-shaped side elevation and rails 29*a*, 29*a* are disposed along upper and the lower legs thereof. The slide body 30 is adapted to move in sliding contact along the rails 29*a*, 29*b*.

As shown in FIGS. 1, 6, 11 and 12, an operation block 61 is disposed horizontally rotatably in a square hole 30*a* of the sliding body 30 and an operation rod 31 is inserted at its one end into a lateral center hole (hot illustrated) of the operation block 61. The other end of the operation rod 31 is horizontally extended to the extension 2 of the upper plate 1*a* and secured on a side 32*a* of a direction control device 32.

Figure 5:
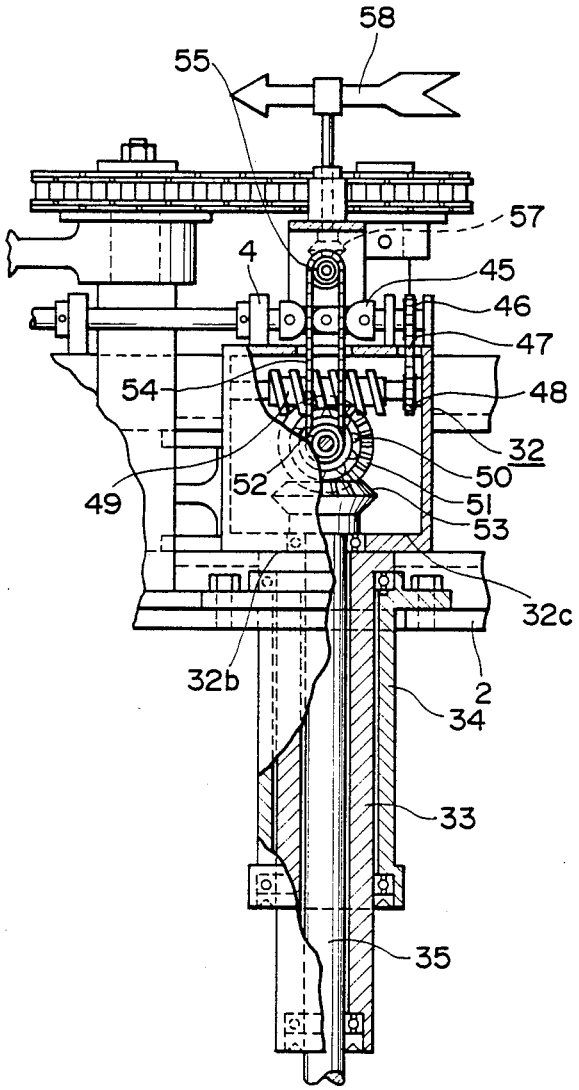
FIG. 5 is a partially cross sectioned elevational view of a direction control device.

As shown in FIGS. 1, 2 and 5, an inner cylindrical shaft 33 is secured at its upper end to a lower surface 32*b* of a bottom plate for the direction control device 32. An outer shaft cylindrical 34 is secured at its upper end by mean of bolts to the extension 2. The inner cylindrical shaft 33 is enhoused rotatably through a hollow inside of the outer cylindrical shaft 34 in such a way that the direction control device 32 is horizontally rotatable. Further, an operation shaft 35 for operating a propulsion blade (described later) is passed through the hollow inside of the inner cylindrical shaft 33 from an upper surface 32*c* of the bottom plate for the direction control device 32. A bevel gear 53 is secured to the upper end of the operation shaft 35. The lower end of the operation shaft 35 is formed as a hexagonal shaft 36 (refer to FIGS. 9 and 10).

Figure 9:
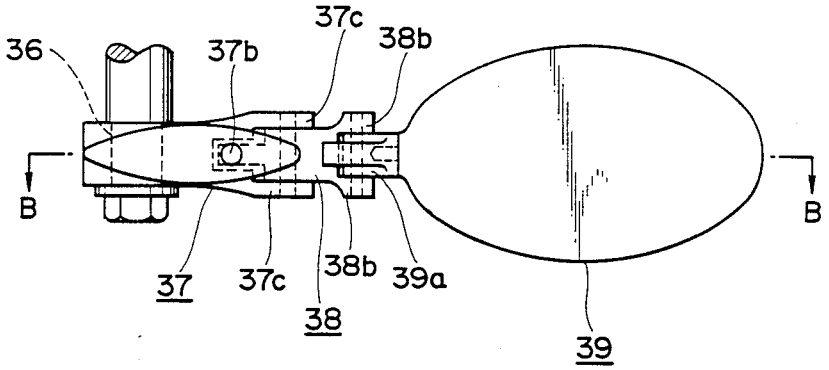
FIG. 9 is a front elevational view illustrating a fin-like propulsion plate.
Figure 10:
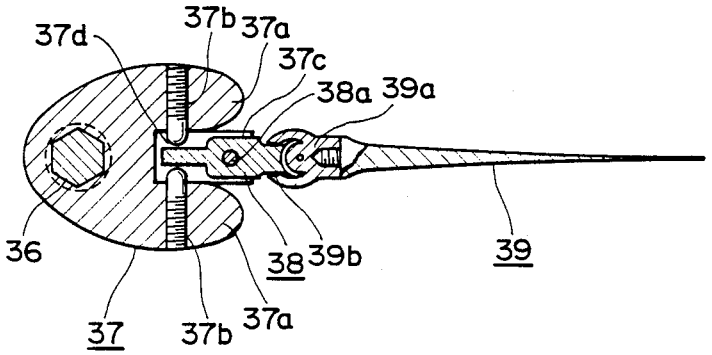
FIG. 10 is a cross sectional view taken along line B—B of FIG. 9.

As shown in FIGS. 9 and 10, the hexagonal shaft 36 is secured to a generally C-shaped metal disk 7 for attaching a fin-like propulsion blade. Adjusting screws 37*b* are engaged to protruding portions 37*a* on both outer sides of the metal disk 37. Further, protrusions 37*c* for mounting a connection metal 38 are formed, respectively, on the upper and the lower sides at the middle portion of the metal disk 37. The connection metal 38 is of a generally square cylindrical shape and a shaft 38*a* is disposed horizontally rotatably at the center thereof. Then, by pivoting the shaft 38*a* to the protrusions 37*c*, 37*c*, the connection metal 38 is attached horizontally rotatably to the metal disk 37. A gap 37*d* is formed between the metal disk 37 and the connection metal 38. Further, protrusion 38*b* in a generally U-shaped configuration for mounting a fin-like propulsion blade 39 (hereinafter referred to as a fin blade) is formed to the rear end of the connection metal 38. The fin blade 39 has an elliptical shape as shown in FIG. 9 and has a horizontally rotatable shaft 39*a* at its top end to be connected with the connection metal 38. By pivoting the horizontal rotational shaft 39*a* to the protrusions 38*b*, 38*b*, the fin blade 39 is attached horizontally rotatably to the connection metal 38. A gap 38*b* is present between the top end of the fin blade 39 and the connection metal 38.

The constitution for the operation mechanisms of the boat propulsion device according to the present invention has been described above. Descriptions will now be made to the constitution of a steering mechanism.

As shown in FIG. 2, a steering mechanism includes a handle 40 and a change-over device 42 connected thereto by means of a flexible shaft 41, and the direction control device 32 connected with the change-over device 42 by means of a flexible shaft 43.

The handle 40 is rotatably attached to two handle bearings 40*a* disposed at the top end of the hand rod 8. The flexible shaft 41 is secured at its one end to the rear end of the rotational shaft of the handle 40 and secured at its the other end to a main conversion shaft 42*c* protruded from the front of the change-over device 42 (refer to FIGS. 3 and 4).

Figure 3:
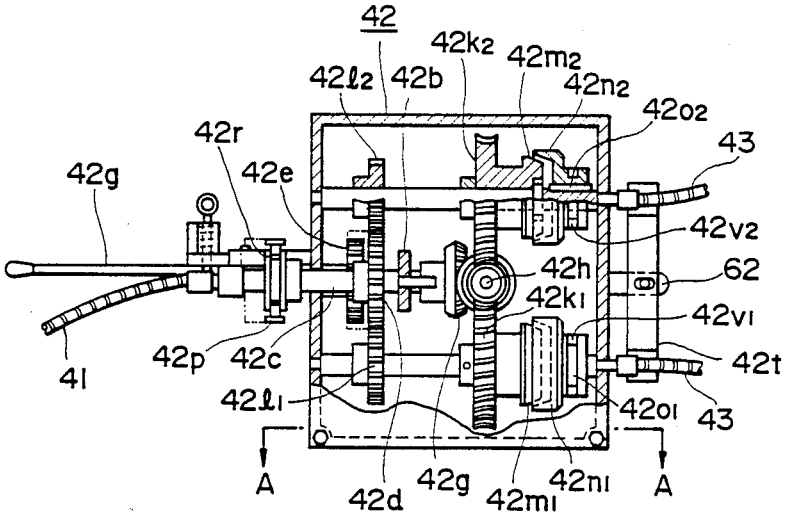
FIG. 3 is a plan view for a change-over device.
Figure 4:
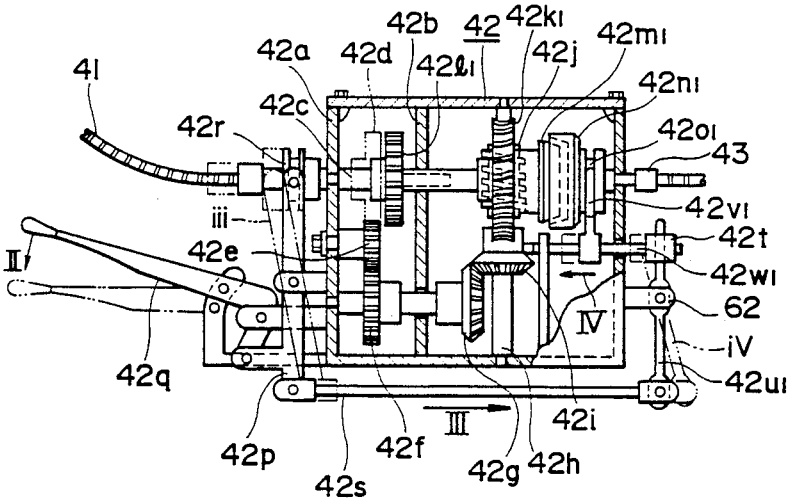
FIG. 4 is a cross sectional view taken along line A—A of FIG. 3.

As shown in FIGS. 3 and 4, a support plate 42*b* for the main conversion shaft 42*c* is disposed vertically at the inside of a box 42*a* of the change-over device 42. The main conversion shaft 42*c* is slidably inserted between the upper portion of the support plate 42*b* and the upper portion of the front plate of the box 42*a*. Further, a spur gear 42*d* is secured at an intermediate portion of the main conversion shaft 42*c* and a spur gear 42*e* that meshes with the spur gear 42*d* is pivoted below the spur gear 42*d*. Further, a spur gear 42*f* is disposed below the spur gear 42*e*. The rotational shaft of the spur gear 42*f* passes through the lower portion of the support plate 42*b*, and a bevel gear 42*g* is secured to the top end thereof. Further, a rotational shaft 42*h* rotatable around its axis stands vertically at a central portion of the box 42*a* and a bevel gear 42*i* is secured to an intermediate portion of the rotational shaft 42*h*. The bevel gear 42*i* meshes with the bevel gear 42*g*. A worm gear 42*j* is secured at the upper end of the rotational shaft 42*h*, and worm wheels $42k_1$, $42k_2$ each meshing with the worm gear 42*j* are secured, respectively, on both right and left sides of the worm gear 42*j*. Rotational clutch plates $42m_1$, $42m_2$ are integrally disposed to the worm wheels $42k_1$, $42k_2$, respectively, and spur gears $42l_1$, $42l_2$ are secured to the ends of the shafts respectively. Further, clutch couplings $42n_1$, $42n_2$ are slidably disposed to the other ends of the shafts for the worm wheels $42k_1$, $42k_2$ being opposed to the rotational clutch plates $42m_1$, $42m_2$, respectively. The clutch couplings $42n_1$, $42n_2$ are usually disengaged from the rotational clutch plates $42m_1$, $42m_2$.

An L-shaped operation support plate 42*p* is pivoted at its intermediate portion to the front panel of the box 42*a* and the upper end of the operation support plate 42*p* is rotatably connected to a metal receptacle 42*r* secured to the main conversion shaft 42*c*. An L-shaped change-over operation plate 42*q* is pivoted to the front panel of the box 42*a* and one end of the change-over operation plate 42*q* is rotatably connected to the lower end of the operation support plate 42*p*. Further, a clutch connection rod 42*s* is rotatably connected at its one end to the lower end of the operation support plate 42*p*. The clutch connection rod 42*s* is disposed below the bottom of the box 42*a* and its other end is protruded from the right side of the box 42*a* and connected rotatably to the lower end of a clutch change-over plate $42u_1$. A horizontal support arm 62 is disposed to on outer backward of the box 42*a* and the clutch change-over plate $42u_1$ is pivoted at its intermediate portion to the horizontal support arm 62. Further, the clutch change-over plate $42u_1$ is connected at its upper end to the center of a lateral clutch connection plate 42*t*. Both of right and left ends of the lateral clutch connection plate 42*t* are connected to top ends of sliding shafts $42w_1$, $42w_2$, respectively. U-shaped metals $42v_1$, $42v_2$ are secured to the sliding shafts $42w_1$, $42w_2$, and the U-shaped metals $42v_1$, $42v_2$ fit to annular grooves $42o_1$, $42o_2$ disposed to the clutch couplings $42n_1$, $42n_2$ for receiving sliding metals.

As shown in FIGS. 2 through 4, each of the flexible shafts 43 is secured at its one end to the shaft of each worm wheel $42k_1$, $42k_2$ while the flexible shaft 43 is secured at the other end by way of a support arm 44, which is extended and secured from the front of the slide bed 29 (refer to FIG. 1), to one end of a universal joint 45 horizontally pivoted to the upper portion of the direction control device 32 (refer to FIG. 5).

Figure 6:
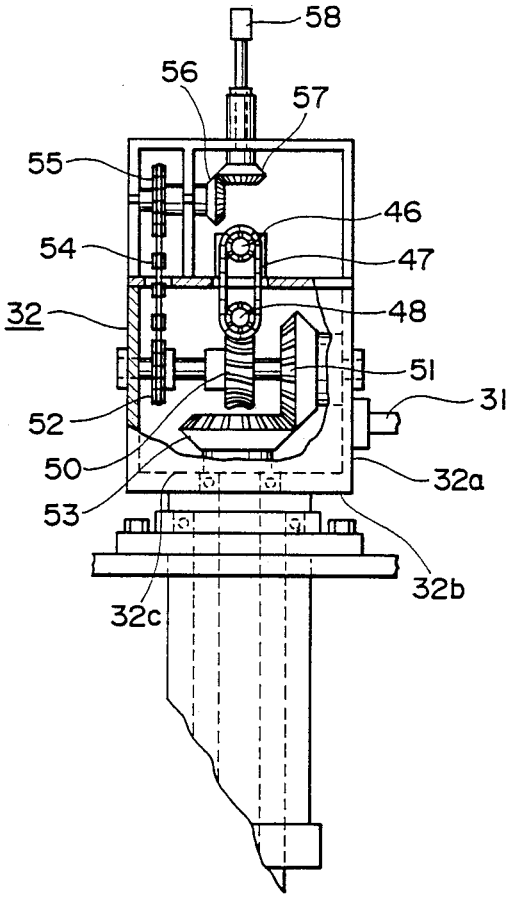
FIG. 6 is a partially cross-sectioned right side elevational view of the direction control device.

As shown in FIGS. 5 and 6, a sprocket 46 is secured to the rear end of the universal joint 45. At the upper inside of the direction control device 32, a worm gear 49 is pivoted in parallel with the universal joint 45, and a sprocket 48 is secured to the axial end of the worm gear 49. Then, the sprocket 48 is connected by way of a chain 47 to a sprocket 46. A wheel gear 50 is rotatably disposed at a central inside of the direction control device 32, and the wheel gear 50 meshes with the worm gear 49. The shaft of the wheel gear 50 and the shaft of the worm gear 49 are in perpendicular to each other. A bevel gear 51 is secured to one end of a shaft for the wheel gear 50, while a sprocket 52 is secured to the other end of the shaft. A bevel gear 53 is secured to the upper end of the propulsion blade operation shaft 35 in the direction control device 32 and the bevel gear 53 meshes with the bevel gear 51. Further, a sprocket 55 is rotatably disposed in an upper inside of the direction control device 32, and the sprocket 55 is connected by way of a chain 54 to the sprocket 52. A bevel gear 56 is secured to one end of a shaft for the chain wheel 55 and the bevel gear 56 meshes with a bevel gear 57 pivoted vertially at an upper inside of the control direction device 32. Then, a steering direction indicator 58 is secured to the upper end of the shaft for the bevel gear 57, so that the steering direction may be confirmed.

The same steering mechanism as described above are also disposed on the side of the clutch coupling $42n_2$. However, since the constitutions are substantially identical with those connected to the clutch coupling $42n_1$ described above, descriptions therefor are omitted.

Operation of the Propulsion Device

Operation of this illustrated embodiment will now be described.

As shown in FIG. 1, when a rower reciprocates the hand rod 8 by gripping its top end as shown by the arrow I, the operation rod 11 pivoted to the annular receptacle 9 moves as shown by the dotted chain line (i). In this case, since the support rod 4 to which the hand rod 8 is fitted is vertically pivoted to the sliding body 3*f*, the rower can reciprocate the hand rod 8 horizontally along a predetermined trace as shown by the solid line (ii) in FIG. 8.

As shown in FIGS. 1 and 2, the movement transmitted by the foregoing operation is converted into a rotational movement by means of the sprocket 15 secured on the axial center of the operation arm 13, which is further transmitted by way of the chain 16 to the sprocket 18. Further, the movement is transmitted from the small sector gear 19 coaxial with the sprocket 18 by way of the compound gear 21, spur gears 23, 24, 25*a*, and 25*b* to the crank disks 26*a*, 26*b* respectively.

Since identical mechanisms are disposed in a symmetry with respect to the longitudinal center line of the frame 1, descriptions will now be made mainly for the operation of the mechanisms disposed on the left side (toward the bow).

Figure 11:
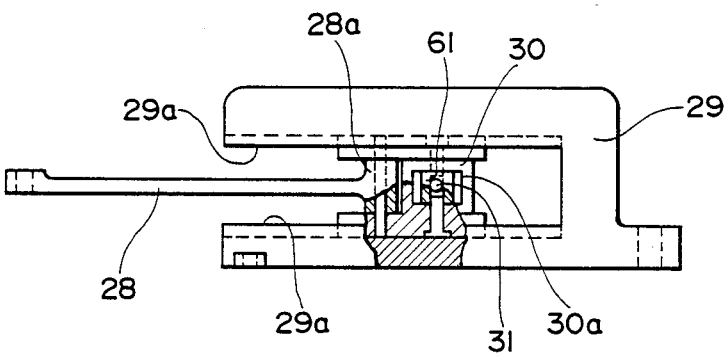
FIG. 11 is an enlarged front elevational view around a slide bed.
Figure 12:
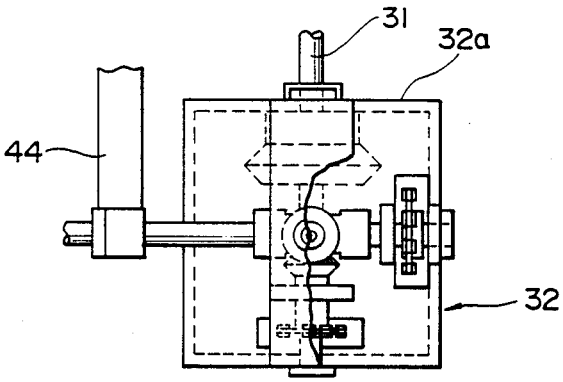
FIG. 12 is a plan view of the direction control device.
Figure 13:
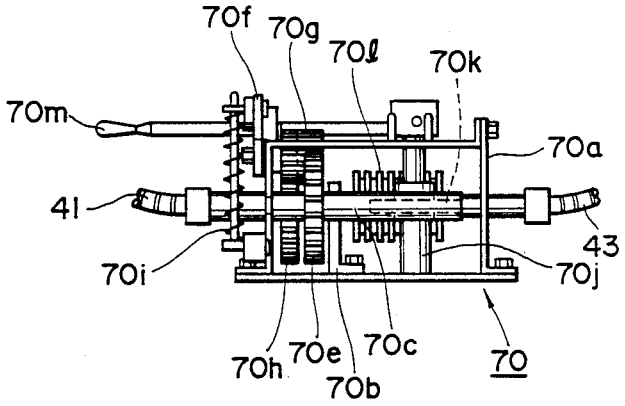
FIG. 13 is a front elevational view of another embodiment of the change-over device.
Figure 14:
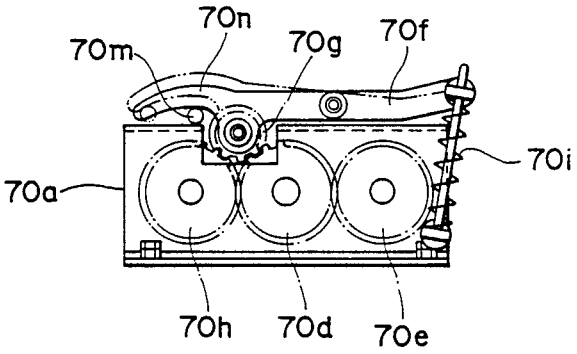
FIG. 14 is a right side elevational view thereof.
Figure 15:
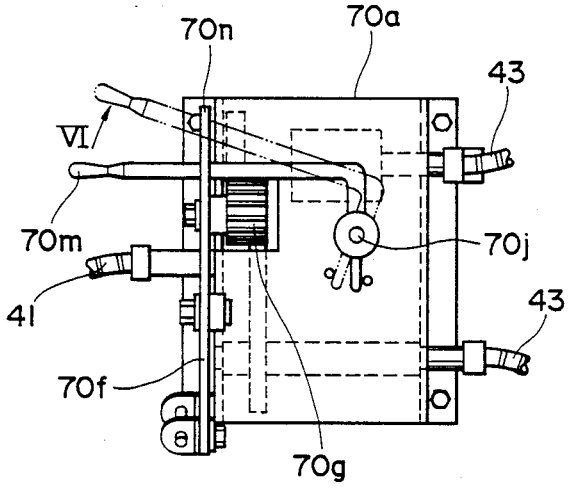
FIG. 15 is a plan view thereof.
Figure 16:
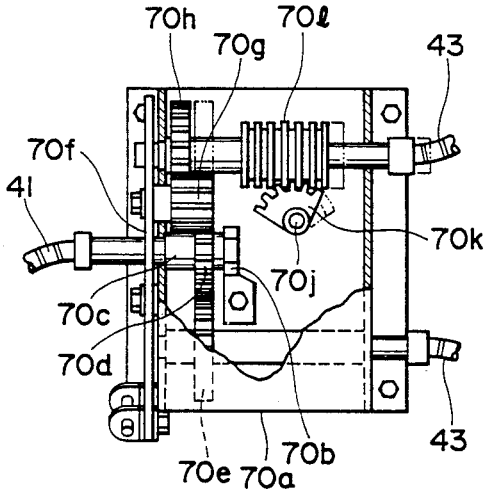
FIG. 16 is a partially cross sectioned plan view of FIG. 15.

The rotational movement transmitted as far as the crank disk 26*a* is converted into the horizontal forward and backward movement by the sliding body 30 by interlocking the movement of the connection stud 27 disposed at the upper circumferential edge of the crank disk 26*a* with that of the sliding body 30 in the slide bed 29 by way of the crank shaft 28 (also refer to FIG. 11). Then, since the top end of the operation rod 31 is secured on the side 32*a* of the direction control device 32 rotatably mounted to the extension 2 of the upper plate 1*a*, when the operation rod 31 moves in accordance with the horizontal forward and backward movement of the sliding body 30, the direction control device 32 rotates horizontally. As a result, the operation shaft 35 secured below the bottom plate 32*b* of the direction control device 32 also rotates horizontally, thereby causing horizontal swinging of the fin blade 39 attached to the lower end of the operation shaft 35 by means of the metal disk 37. In this case, since the gaps 37*d*, 39*b* are formed, respectively, in a right to left symmetry to the connection portions between the metal disk 37 and the connection metal 38 and the fin blade 39 (refer to FIG. 10), when the fin blade 39 swings horizontally, it is entirely waved to improve the propulsive force.

Then, descriptions will be made to the operation of the steering mechanism in the propulsion device.

At first, description is made to a state in which the spur gear 42*d* meshes with the spur gears $42l_1$, $42l_2$ in the change-over device 42 (refer to FIGS. 3 and 4). When the handle 40 disposed at the top end of the hand rod 8 (refer to FIG. 2) is rotated clockwise, the spur gear 42*d* of the main conversion shaft 42*c* connected by way of the flexible shaft 41 to the handle 40 rotates clockwise (as viewed toward the stern). On the other hand, the respective shafts of the clutch couplings $42n_1$, $42n_2$ connected to the spur gear 42*d* by way of the spur gears $42l_1$, $42l_2$ rotate counterclockwise, respectively (as viewed toward the stern). The counterclockwise rotation for the respective shafts of the clutch couplings $42n_1$, $42n_2$ is transmitted by way of the flexible shafts 43 to the universal joints 45 (refer to FIG. 2). Further, as shown in FIGS. 5 and 6, the rotation of each of the universal joints 45 is transmitted by way of the chain 47 to the worm gear 49 and then to the worm wheel 50 that meshes with the worm gear 49. Then, the rotation is transmitted by way of the bevel gear 51 coaxial with the worm wheel 50 to the bevel gear 53 as the clockwise rotation. Since the upper end of the operation shaft 35 for the fin blade 39 is secured to the bevel gear 53, when the operation shaft 35 rotates clockwise toward the bottom of the boat, the angle of the fin blade 39 secured to the lower end of the shaft 35 (FIG. 2) is displaced leftwardly (counterclockwise) toward the bow relative to the usual position. As a result, the boat can be steered leftward relative to the advancing direction of the boat.

Then, as shown in FIG. 4, when the change-over operation plate 42*q* is lowered as shown by the arrow II, since the operation support plate 42*p* moves as shown by the dotted chain line (iii), the main conversion shaft 42*c* connected by way of the metal receptacle 42*r* to the operation support plate 42*p* can be moved slidingly toward the bow. In this case, the spur gear 42*d* disengages from the spur gears $42l_1$, $42l_2$ and meshes with the spur gear 42*e*. Meanwhile, the clutch connection rod 42*s* connected at its one end to the lower end of the operation support plate 42*p* moves as shown by the arrow III, and the clutch change-over plates $42u_1$, $42u_2$ connected at the lower end thereof to the other end of the connection rod 42*s* is moved as shown by the dotted chain line (iv). Then, the clutch couplings $42n_1$, $42n_2$ mesh with the clutch rotation plates $41n_1$, $41n_2$, respectively, by the U-shaped metals $42v_1$, $42v_2$ on the sliding shafts $42w_1$, $42w_2$, to which the upper ends of the clutch change-over plates $42u_1$, $42u_2$ are pivoted, to attain a state capable of transmitting the movement.

As shown in FIGS. 2 through 4, when the handle 40 is rotated clockwise in this state, the spur gear 42*d* of the main conversion shaft 42*c* connected to the handle 40 by way of the flexible shaft 41 rotates clockwise (as viewed toward the stern). Subsequently, the rotation is transmitted by way of the spur gear 42*e*, the spur gear 42*f*, the bevel gear 42*g* at the axial end of the spur gear 42*f*, the spur gear 42*i* secured to the rotational shaft 42*h* and the worm gear 42*j* to the worm wheels $42k_1$, $42k_2$, respectively, as the counterclockwise rotation and the clockwise rotation (as viewed toward the stern). Then, they are transmitted from the rotational clutch plates $42m_1$, $42m_2$ integral with the worm wheels $42k_1$, $42k_2$ by way of the clutch couplings $42n_1$, $42n_2$ to the universal joints 45, 45 secured to the right and left flexible shafts 43, 43 as the counterclockwise rotation and the clockwise rotations, respectively. Subsequently, the rotation from the worm wheel $42k_1$ is transmitted from the universal joint 45 to the operation shaft 35 thereby causing the left fin blade 39 attached to the operation shaft 35 to rotate counterclockwise (as viewed toward the bow). On the other hand, rotation from the worm wheel $42k_2$ is transmitted by the similar transmission path as described above. Since the rotation is clockwise, the right fin blade 39 attached to the operation shaft 35 rotates clockwise (as viewed toward the bow). Accordingly, when the handle 40 is continuously rotated clockwise, the fin blades 39 rotate to the outside of the boat along dotted circles as shown by the arrow V in FIG. 1, by which a braking operation is applied. When the handle 40 is rotated further, the right and left fin blade 39 are rotated further exceeding the 90° positions and can be set to angular positions opposite to usual case. Accordingly, when the hand rod 8 is reciprocated horizontally rightward and leftward in this blade position, the boat can be moved backwardly.

As shown in FIGS. 3 and 4, the structure of the change-over device 42 is somewhat complicate in the foregoing embodiment but the change-over operation can be conducted similarly also by a modified embodiment of the following simple structure, which will be explained briefly.

As shown in FIGS. 13 through 16, a change-over device 70 has a vertically disposed support plate 70*b* for a main conversion shaft 70*c* at the inside of a frame 70*a*. The main conversion shaft 70*c* connected to a flexible shaft 41 (similar to that in the previous embodiment shown in FIGS. 1 to 4) is rotatably inserted between the support plate 70*b* and a front plate of the frame 70*a*. A spur gear 70*d* is secured at an intermediate portion of the main conversion shaft 70*c*, and the spur gear 70*d* meshes with a spur gear 70*e* which is rotatably disposed on the left side thereof. A shaft for the spur gear 70*c* is rotatably disposed between the front and the rear plates of the frame 70*a*, and the left flexible shaft 43 (similar to that in the previous embodiment) is connected to the shaft end protruded from the rear plate of the frame 70*a*. Accordingly, when the flexible shaft 41 is rotated by the operation to the handle 40 (show in FIG. 1), the left flexible shaft 43 is rotated in the direction opposite to that of the flexible shaft 41. Further, a swing lever 70*f* is pivoted at its intermediate portion to the upper surface of the frame 70*a* and a spur gear 70*g* is pivoted to one end of the swing lever 70*f*. Further, a spur gear 70*h* is rotatably disposed on the right side of the spur gear 70*d* and, usually, the spur gear 70*g* meshes both with the spur gear 70*h* and the spur gear 70*d*. Engagement between the spur gear 70*g* and the spur gears 70*h*, 70*d* can be attained by biasing the other end of the swing lever 70*f* upward by a spring 70*i*. Since the spur gear 70*g* is disposed between the spur gear 70*h* and the spur gear 70*d* as described above, when the flexible shaft 41 is rotated by the operation of the handle 40, a shaft of the spur gear 70*h* is rotated in the same direction as the flexible shaft 41. That is, the right flexible shaft 43 connected to a shaft of the spur gear 70*h* can be rotated in the same direction as the flexible shaft 41.

A vertical shaft 70*j* rotatable around its axis is disposed at the lateral center of the frame 70*a* and a sector gear 70*k* is secured at an intermediate portion of the vertical shaft 70*j*. Further, a cylindrical rack gear 70*l* is secured to a shaft for the spur gear 70*h* and the spur gear 70*k* is engaged into a groove of the cylindrical rack gear 70*l*. Further, the vertical shaft 70*j* is protruded at its upper end from the upper surface of the frame 70*a* and an L-shaped gear conversion rod 70*m* is secured to the protruded end. Further, the gear conversion rod 70*m* is engaged at its intermediate portion with an engaging part 70*n* integrally formed to the swing lever 70*f* and, when the gear conversion rod 70*m* is operated as shown by the arrow VI in FIG. 15, it is possible to rotate the swing lever 70*f* to disengage the gear 70*g* from the spur gears 70*h*, 70*d*. It is also possible to rotate the vertical shaft 70*j* to thereby slide the shaft of the spur gear 70*h* by way of the sector gear 70*k* and the cylindrical rack gear 70*l* toward the stern, thereby engaging the spur gear 70*h* with the spur gear 70*d*. Then, when the flexible shaft 41 is rotated by the operation of the handle 40 in this state, both of the right and left flexible shafts 43 can be rotated in the direction opposite to that of the flexible shaft 41.

According to the present invention, since the man-powered boat propulsion device has been constituted as described above, it is possible to manually generate a great propulsive force for moving the boat, as well as easily conduct the steering operation, by providing the man-powered propulsion device to the boat. In addition, it can also provide excellent effects capable of improving the boat rotating function and stopping function, and simplifying backward movement of the boat, as well as enabling easy steering operation even to those unskilled in oar or scull operation.

What is claimed is:

1. A man-powered boat propulsion device mounted on a boat comprising:

a first rod-like means reciprocated horizontally by rower's hands, a second rod-like means connected vertically at its upper end to said first rod-like means and capable of moving along an arcuate trace in accordance with a reciprocating movement of said first rod-like means, a support means disposed in sliding contact with a lower end of said second rod-like means for slidably supporting and guiding said lower end along an arcuate trace, a third rod-like means pivoted at its one end to a portion of said second rod-like means and capable of swinging rightward and leftward alternately around said pivoted portion as a center, a shaft-like means connected vertically at its one end to the other end of said third rod-like means by way of an interlocking means and capable of rotating horizontally clockwise and counterclockwise alternately in accordance with the horizontal reciprocating movement of said first rod-like means, a fin-like propulsion means secured to said shaft-like means and capable of horizontally rotating both rightward and leftward, in accordance with the alternate clockwise and counterclockwise rotation of said shaft-like means, a handling means connected to said first rod-like means and capable of turning clockwise and counterclockwise, a change-over means connected to said handling means and capable of transmitting the turning movement of said handling means, changeably between clockwise and counter-clockwise directions, and a direction control means connected to said change-over means on one hand and to said shaft-like means on the other hand and capable of transmitting the turning movement to said shaft-like means.

2. A man-powered boat propulsion device as defined in claim 1, wherein the support means connected with the lower end of the second rod-like means comprises a slide bed of a generally arcuate shape in a horizontal transverse section and having an upwardly concave upper gear face with a row of teeth pointing upward, and a sliding body having a sector gear meshing with said upper gear face and pivoted to the lower end of said second rod-like means.

3. A man-powered boat propulsion device as defined in claim 1, wherein the direction control means comprises a universal joint connected, at one end, to said change-over means and, at the other end, by way of a gear train to said shaft-like means.

4. A man-powered boat propulsion device as defined in claim 1, wherein the fin-like propulsion means is attached to the shaft-like means by way of an attaching metal and a connection metal pivoted with a gap to said attaching metal, and said fin-like means is pivoted to said connection metal with a gap.

5. A man-powered boat propulsion device mounted on a boat comprising:

a first rod-like means reciprocated horizontally by rower's hands, a second rod-like means connected vertically at its upper end to said first rod-like means and capable of moving along an arcuate trace in accordance with a reciprocating movement of said first rod-like means, a support means disposed in sliding contact with a lower end of said second rod-like means for slidably supporting and guiding said lower end along an arcuate trace, a third rod-like means pivoted vertically at its one end to a portion of said second rod-like means and capable of swinging rightward and leftward alternately around said pivoted portion as a center, an interlocking mechanism connected at its one end to the other end of said third rod-like means in such a way as to convert the swinging movement of said third rod-like means into a rotational movement and comprising a pair of transmission means for transmitting said rotational movement into two directions, the rotation in said two directions being opposite to each other.

a pair of shaft-like means connected respectively to said pair of transmission means and capable of rotating horizontally clockwise and counterclockwise alternately, the rotating directions being opposite to each other between the pair, in accordance with the horizontal reciprocating movement of said first rod-like means, respectively, a pair of fin-like propulsion means secured to said pair of shaft-like means respectively and capable of horizontally rotating rightward and leftward, in accordance with the alternate clockwise and counterclockwise rotation of said shaft-like means, the rotating directions being opposite to each other between the pair, a handling means connected to said first rod-like means and capable of turning clockwise and counterclockwise, a change-over means connected to said handling means and capable of transmitting the turning movement of said handling means, changeably, between clockwise and counter-clockwise directions, and a pair of direction control means connected to said change-over means on one hand and to said pair of shaft-like means, respectively, on the other hand and capable of transmitting the turning movement to said pair of shaft-like means, respectively.

6. A man-powered boat propulsion device as defined in claim 5, wherein the support means connected with the lower end of the second rod-like means comprises a slide bed of a generally arcuate shape in a transverse section and having an upwardly concave upper gear face with a row of teeth pointing upward, and a sliding body having a sector gear meshing with said upper gear face and pivoted to the lower end of said second rod-like means.

7. A man-powered boat propulsion device as defined in claim 5, wherein the direction control means comprises a universal joint connected, at one end, to said change-over means and, at the other end, by way of a gear train to said shaft-like means.

8. A man-powered boat propulsion device as defined in claim 5, wherein the fin-like propulsion means is attached to the shaft-like means by way of an attaching metal and a connection metal pivoted with a gap to said attaching metal, and said fin-like means is pivoted to said connection metal with a gap.

* * * * *